United States Patent [19]

Maudal

[11] 4,417,520

[45] Nov. 29, 1983

[54] SEQUENTIAL TIME DISCRIMINATION SYSTEM FOR SUB-DELIVERY SYSTEMS

[75] Inventor: Inge Maudal, Claremont, Calif.

[73] Assignee: General Dynamics, Pomona Division, Pomona, Calif.

[21] Appl. No.: 139,947

[22] Filed: Apr. 14, 1980

[51] Int. Cl.[3] ..... F41G 7/22; F42B 13/50

[52] U.S. Cl. ..... 102/489; 102/384

[58] Field of Search ..... 102/489, 374, 364, 365, 102/384, 393, 394, 213; 244/3.16, 3.15, 3.1

[56] References Cited

U.S. PATENT DOCUMENTS

| | | | |
|---|---|---|---|
| 2,804,823 | 9/1957 | Jablansky | 102/377 |
| 2,870,710 | 1/1959 | Miedel | 102/393 |
| 3,124,072 | 3/1964 | Herrmann | 102/374 |
| 3,318,241 | 5/1967 | Gould | 102/393 |
| 3,712,228 | 1/1973 | Handler et al. | 102/513 |
| 3,727,861 | 4/1973 | Swann | 244/3.15 |
| 3,857,338 | 12/1974 | Bucklisch | 102/383 |
| 3,940,443 | 2/1976 | Glass et al. | 102/363 |
| 4,157,068 | 6/1979 | Rognmo | 102/489 |
| 4,242,962 | 1/1981 | Wakeman et al. | 102/213 |
| 4,281,809 | 8/1981 | Oglesby et al. | 244/3.16 |

*Primary Examiner*—Charles T. Jordan

*Attorney, Agent, or Firm*—Henry M. Bissell; Edward B. Johnson

[57] ABSTRACT

A delivery system for multiple sub-missiles including in the sub-missiles a marking system, a detection system, a diverter for elimination of targets identified by the detector system, a scanner for initial determination of multiple targets, a logic circuit utilizing input from both the diverter and the scanner to eliminate targets and a sub-missile guidance system.

11 Claims, 5 Drawing Figures

SEQUENTIAL TIME DISCRIMINATION SYSTEM FOR SUB-DELIVERY SYSTEMS

BACKGROUND OF THE INVENTION

1. Field of the Invention

The present invention relates to the delivery of multiple independent warheads or other vehicles originating from a single initial delivery system to selected targets wherein a system is provided to eliminate previously utilized targets within each sub-missile system so as to avoid duplicate delivery of sub-missiles to the same target.

2. Description of the Prior Art

Many multiple unit projectiles or sub-missiles have been proposed in the past for destroying targets on the ground and in the air. For example, U.S. Pat. No. 2,804,823 to Jablansky discloses a multiple unit projectile which is fired as a single unit, separates in flight into various components, and eventually strikes targets after a suitable time delay. In addition, U.S. Pat. No. 2,870,710 to Miedel also provides for multiple sub-projectiles which strike targets in a manner similar to that of a salvo of projectiles fired simultaneously.

As an improvement to the above systems, U.S. Pat. No. 3,318,241 to Gould discloses a projectile which disperses miniature rockets over a relatively large area, each of which is propelled by its own charge, resulting in a larger attack area. U.S. Pat. No. 3,727,861 to Swann further improves such a system by the provision of an infrared search and detection system and a lock-on guidance system which, after target determination, releases a restraining parachute and propels the sub-missile toward the selected target. This type of independently guided sub-missile is also shown in U.S. Pat. No. 3,124,072 to Herrmann which discloses an anti-tank missile system which expels a quick succession of sub-missiles, each of which independently homes in on a target. None of these systems, however, provide for discrimination between targets which have previously been selected or utilized by another sub-missile from the same carrier, or a sub-missile from a previously fired missile.

SUMMARY OF THE INVENTION

In accordance with the present invention, a weapons system and method for destroying targets on the ground are provided. The system comprises an airborne vehicle which may, for example, be delivered by a powered flight vehicle or a glide vehicle. The vehicle contains a plurality of sub-vehicles which may be released in a salvo or individually. The vehicle also carries a control system and a mid-course guidance system coupled to the control system. The guidance system directs the vehicle to a predetermined area, for example to an area where targets have previously been spotted. Each of the sub-vehicles contains its own guidance system for control and/or propulsion and is independently directed by a target selector or target logic control unit which receives independent input from a target scanner. The target scanner may, for example, be an infrared scanner, heat scanner, or other target identifying system. In addition, the target selector receives input from a diverter which in turn receives input from a marker detector. The marker detector, provided in each of the sub-vehicles, senses information signals received from targets hit by previously fired sub-vehicles. In accordance with an aspect of the invention, the sub-vehicles herein may be provided with the capability of marking a target after or at delivery. The marker detector having determined, in accordance with the present invention, that certain targets have been previously hit by sub-vehicles, then relays the information to the diverter which provides the information to the target selector. The target selector then provides the appropriate information to the guidance system, which directs the sub-vehicle to a different target from that which has already been hit.

The target scanner system of the sub-vehicles of the present invention may be infrared detectors, heat seekers or other equivalent target selection means, and may use the same or different data retrieval means as the marker detector, which may also be one or more of the same forms. However, in the preferred embodiment, the target scanner is an infrared system, the marker detector system is responsive to petroleum fires and the markers are petroleum substances. In this preferred form, each sub-vehicle contains petroleum based material, which burns upon impact of the sub-vehicle, and thus identifies the target as being struck.

Optionally, in another embodiment, the marker detector may be sensitive to, for example, petroleum fires, and discriminate against such fires. In this form, the marker, if used, would also, preferably produce the appropriate petroleum fire residue and thus the system would have the added advantage of sensing and discriminating against targets destroyed by other means, such as missiles without markers, ground fire, secondary explosions, etc.

In another embodiment the marker may constitute any material which produces a signal or radiation in a particular frequency spectrum. The type of marker signal selected is limited to those compatible with and detectable by the marker detector on subsequently launched sub-vehicles or missiles so that the detector/-diverter/target selector system functions as described herein.

In another preferred embodiment, the sub-vehicles are time sequenced for propulsion towards targets. As a result thereof, the first of the sub-vehicles would strike its target, as determined by the target scanner marker detector (if data is available) and target selector, and then subsequent sub-vehicles would reject targets indicated as already attached by the marker of previously impacted sub-vehicles. Thereafter, the remaining sub-vehicles' target scanner and selector functions would lock on separate, not previously targeted, locations.

In still another preferred embodiment, the sub-vehicles are individually launched from a mortar tube, for instance. Mortar tube-fired vehicles typically follow a ballistic missile type of trajectory and thus produce the desired angle of attack against ground targets, i.e. attack from above the target. Further, the desired time sequence for sub-vehicle firing is either automatic, due to the inherent time lag between successive firings of a mortar, or controllable due to the ability of the personnel to select firing times.

This system is ideally suited for systems designed to attach ground vehicles and for use in a missile which releases numerous sub-missiles which remain suspended in the atmosphere by means such as parachutes, drag chutes or ballutes. Each sub-vehicle would be provided with target scanner, marker detector, diverter, target selector, and sub-vehicle guidance system. The guidance system may take the form of the directional control system and/or propulsion system. The propulsion system type is obviously most preferred as it would provide a greater range for each of the sub-vehicles.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENT

Figure 1:
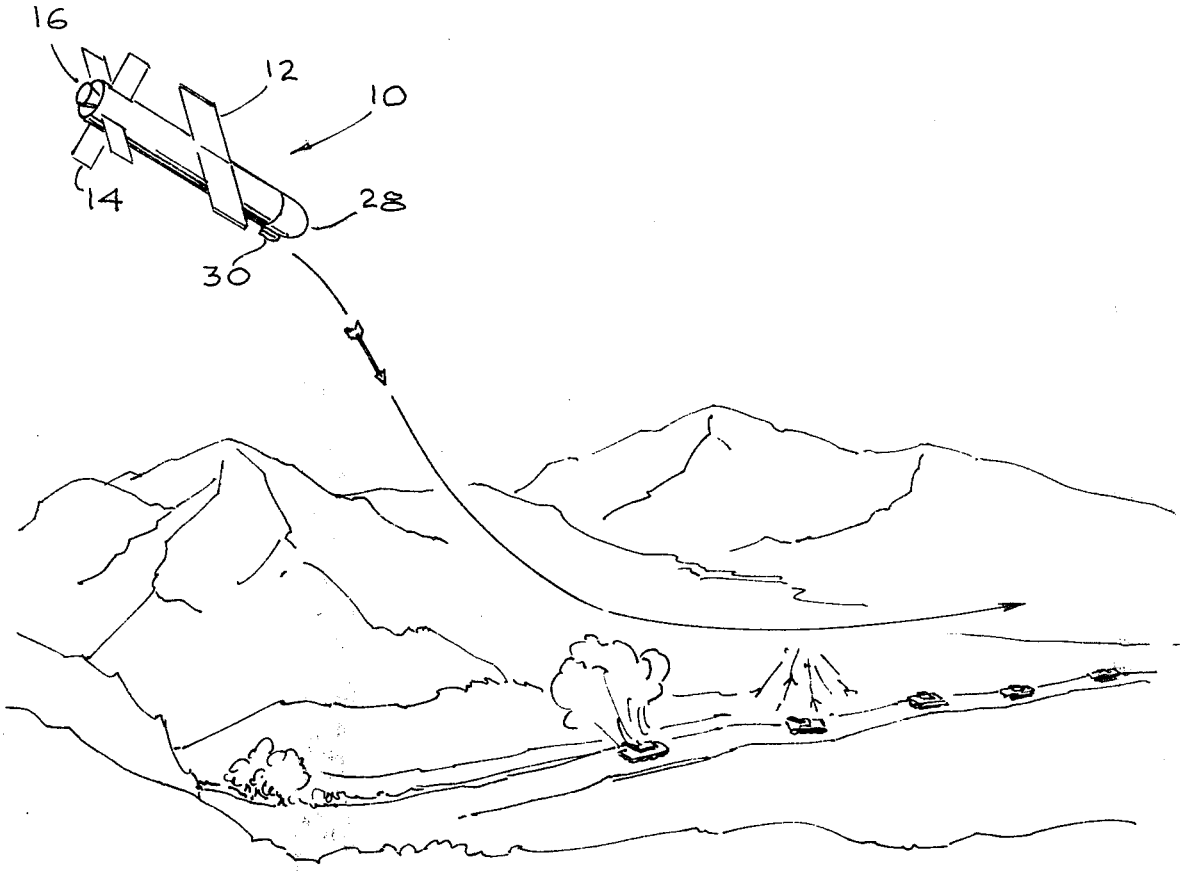
FIG. 1 is a schematic representation illustrating a guided airborne vehicle about to descend on a number of targets prior to the release of multiple sub-vehicles.

The weapon system of the present invention has, for its main purpose, the destruction of enemy targets. It may actually destroy numerous targets, such as tanks, trucks, armored personnel carriers, etc., especially when such targets are travelling in a closely arranged group, such as a column or an array. As shown in FIG. 1, an airborne vehicle 10 is provided, which may be a powered flight or glide vehicle. It may be provided with wings 12 and stabilizing fins 14, and may be of the powered type, and thus would have a rocket motor and an exhaust, which is shown at 16. Vehicle 10 is also provided with multiple warheads of convenient design and, as particularly shown in FIG. 2, vehicle 10 is provided with airframe 20 and control system or autopilot 32 and sub-vehicles 24. The vehicle is also provided with a long range or mid-course guidance system 26 coupled to the vehicle control system 22 as shown. Also shown is a medium range search-seeker device 28 which includes a radiant energy sensor, also coupled to control system 22. Finally a short range seeker-sensor device 30 is also provided, in this exemplary system, for controlling release of the sub-vehicles 24.

Figure 2:
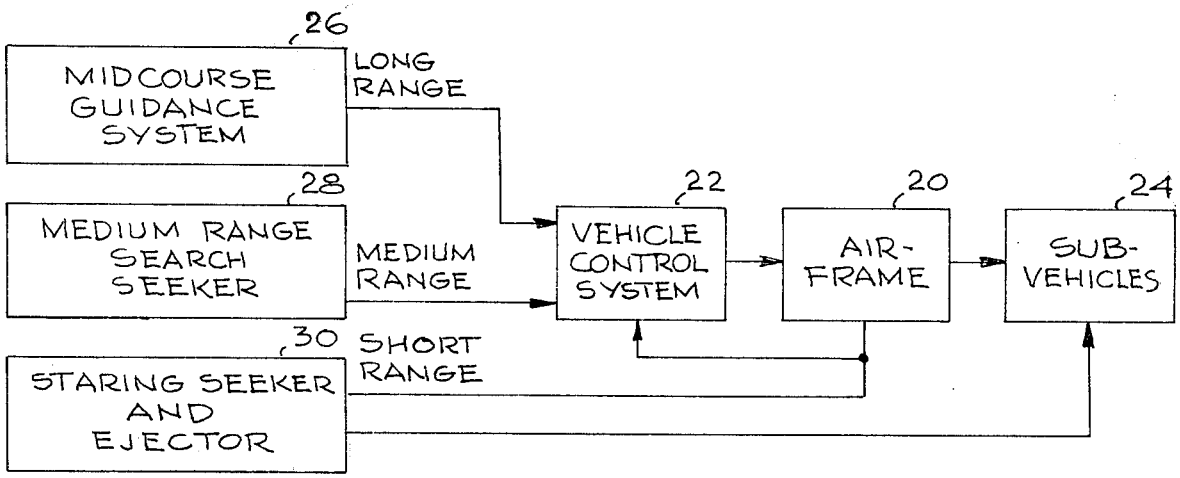
FIG. 2 represents an exemplary guidance system, in block diagram, for the main vehicle prior to release of the sub-vehicles.

As shown particularly in FIGS. 1 and 2, mid-course guidance system 26 inputs to control system 22 in order to fly vehicle 10, for example, from point to point prior to release of the sub-vehicles. Vehicle 10 may be launched either from the air or the ground toward a specific predetermined target, may be programmed in mid-course, may be directed by external communications, or may even be programmed for a predetermined search pattern calculated to locate probable targets. Medium range search seeker 28 may be provided to assist in the location of probable targets, and after a number of targets have been determined, would actuate the ejection of sub-vehicles 24. The altitude at the time of ejection of the sub-vehicles would depend upon the preferred embodiment utilized, but in its preferred form the main vehicle should be at an altitude which permits appropriate timing and actuation of the sub-vehicle control system of the present invention. It should be understood that the weapon system and method of the present invention relate to the delivery system of the sub-vehicles, rather than to the directing of vehicle 10 to the target area.

Figure 3:
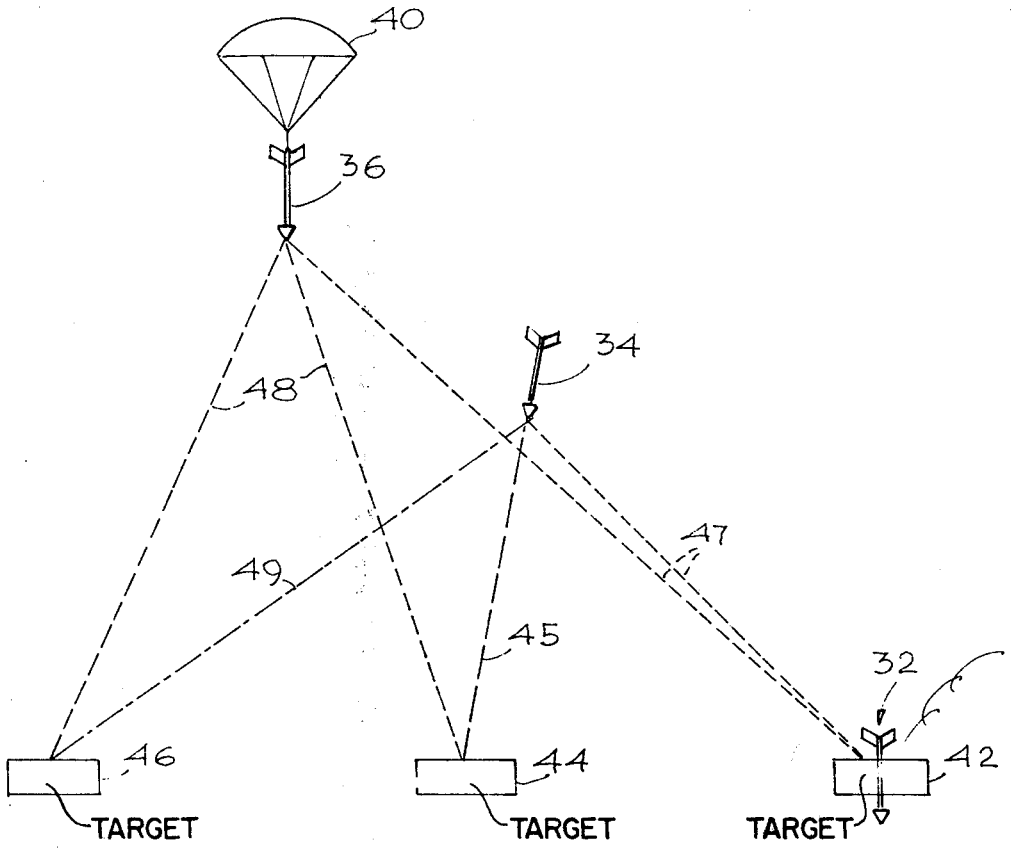
FIG. 3 is a schematic diagram of the preferred target discrimination system showing its functions.

In the particular embodiment depicted in FIG. 3, sub-vehicles 32, 34 and 36 have been deployed from, for example, vehicle 10, at point 24 (shown in FIG. 2) in the process shown in FIGS. 1 and 2. Sub-vehicles 32, 34 and 36 have been time sequenced to provide sufficient delay between impact and explosion of sub-vehicle 32, and impact and explosion of sub-vehicle 34, for the marking material contained in sub-vehicle 32 to be detected by the marker detector (represented by 50 in FIG. 4), diverted by diverter 52, and rejected as a target by target selector 54, of sub-vehicle 34 and, of course, all other sub-vehicles. The same time sequence requirements, in this particular case would apply between sub-vehicles 34 and 36, and any subsequent vehicles. However, it should be noted that the marker detector/diverter/target selector system of the present invention is applicable to systems where two or more successive salvoes or clusters of sub-vehicles are fired. In this particular case, the markers of the first salvo, having already been activated, would be detected by the marker detectors of the second and any subsequent salvoes, and these targets would be rejected through the diverter/-target selector system, and the second and other subsequent salvoes would avoid striking targets which had been already hit.

Figure 4:
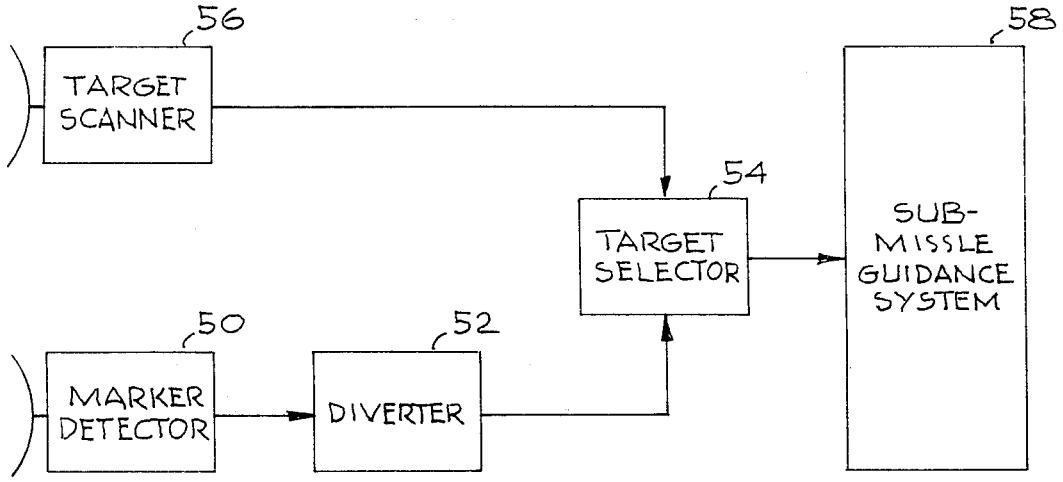
FIG. 4 is a block diagram of a target selection system in accordance with the present invention.

In the most preferred embodiment, sub-vehicle 36 while being suspended by parachute 40 is in a search mode as to its target scanning section (shown as 56 in FIG. 4). While in this search mode, and in the suspended condition, sub-vehicle 36 would select any one of targets 42, 44 and 46, but its marker detector would determine that target 42 had already received a hit and eliminate target 42 after impact of sub-vehicle 32 (the detection being shown by line 47). The remaining targets for sub-vehicle 36 are thus shown by lines 48.

An appropriate time after sub-vehicle 32 has locked on target and is proceeding towards target 42, sub-vehicle 34 would be released from its parachute, either by assuming power (ignition of its propellant) or by automatic release of the parachute from the sub-vehicle, and would begin its rapid descent towards its target. After detection of the strike of sub-vehicle 32 (as shown by line 47) sub-vehicle 34 is left with two targets, i.e. 44 and 46. The logic circuit of target selector 54 would then elect target 44, it being closer to sub-vehicle 34 than is target 46 (the relationship of the distances between the two targets being shown by broken lines 45 and 49). Sub-vehicle 34 would then select and strike target 44, causing the release of the marker material, which would then be detected by sub-vehicle 36 sufficiently in advance of impact (either while in a search mode or while under power) to allow sub-vehicle 36 to select and attack target 46.

In FIG. 4, the relationship of the parts of the logic system of the sub-vehicles of the present invention is shown, wherein marker detector 50 provides a signal to diverter 52, which then provides an indicator to target selector 54 that a given target should not be attacked. All of the targets are input to the target selector through target scanner 56, and then eliminated, as appropriate, through the marker detector and diverter system 50, 52. The target selector then works through its systems, elects the target, and directs the sub-missile guidance system 58, which may be in the form of a propulsion system or merely a control system or both, to the appropriate targets.

In addition, in the most preferred embodiment, marker detector 50 is sensitive to petroleum fires and, as a result, the sub-missiles herein are provided with additional target discriminating capabilities. That is, if a targetable object such as a tank has been destroyed by ground fire or other missiles, the marker detectors in the present sub-missiles will sense the fire and reject the target. Thus, duplication of strikes can be prevented, allowing the use of the present system in conjunction with other known missile systems, even after initial strikes have been made, and have done substantial damage. Further, if only petroleum carrying targets are contemplated, then the marker is not absolutely necessary, but is usually included to insure marking should the sub-missile fail to initiate a fire in sufficient time for subsequent sub-missiles to sense the impact and/or explosion.

Thus, the present invention consists of three parts, in addition to the system of delivery of the sub-vehicles to the area of attack: (1) the sub-vehicle target seeker which in addition to its normal detection system will identify and discriminate against, for example, fire from a petroleum-derived fuel, e.g., burning gasoline; (2) a dispensing mechanism which would release the sub-vehicles at predetermined time intervals or altitudes to provide time differentials between impacts of differing sub-vehicles; and (3) a warhead which includes a petroleum-base component which will burn on impact with the exemplary ground target and mark the target for detection by subsequent sub-vehicles.

Figure 5:
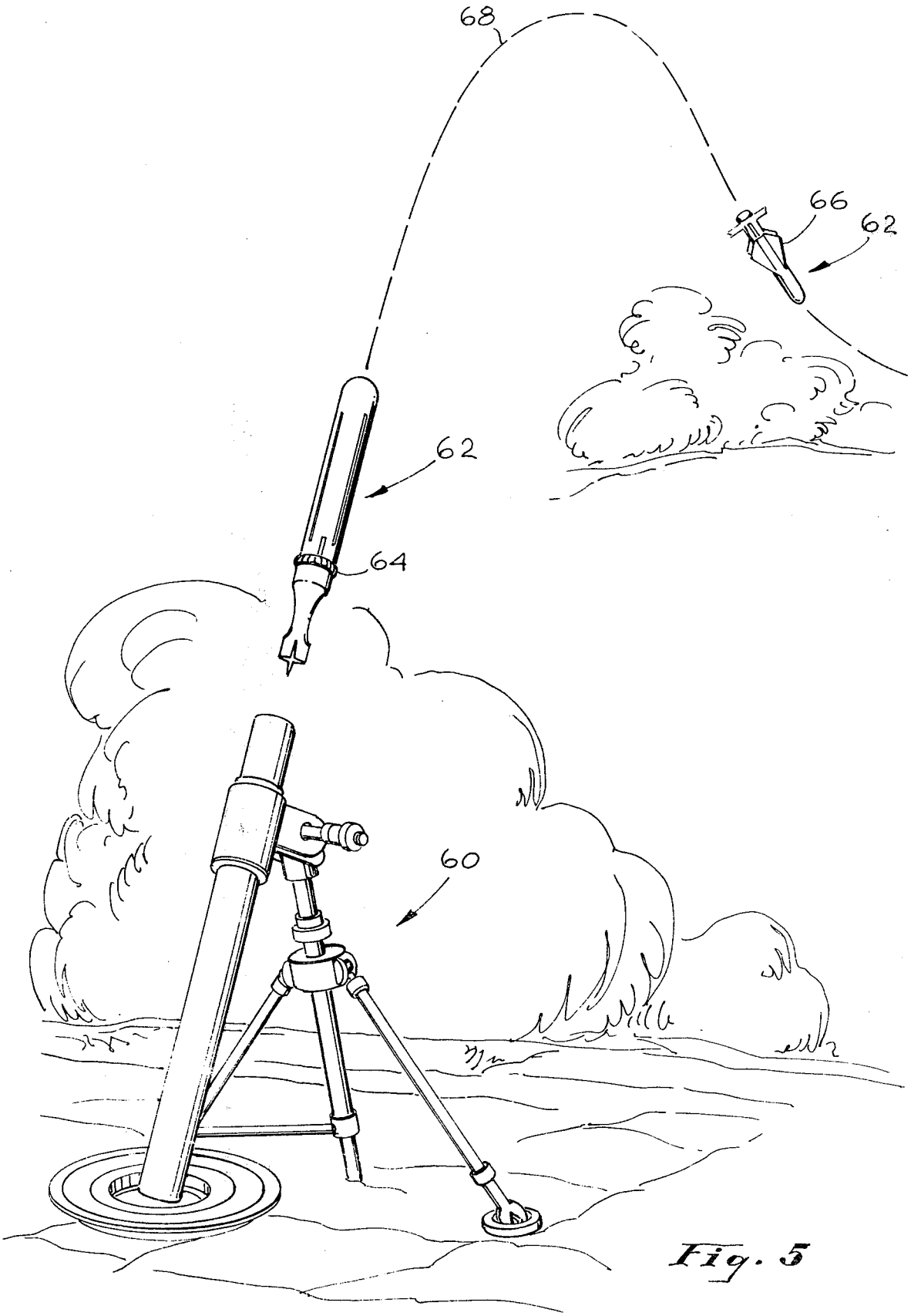
FIG. 5 is schematic of a guided mortar system incorporating the present invention.

In FIG. 5, the system of the present invention is shown incorporating a guided mortar launcher. In the figure, mortar 60 may be one of an array of conventional launchers. The launcher is utilized to launch mortar round 62 which is provided with release ring 64. Release ring 64 is removed immediately after launching by conventional means in order to allow guide fins 66 to project from the mortar round and thus stabilize the round and allow the internal guidance system to operate. Each mortar round is provided with the guidance and sensing system described above such that after launch the projectile travels through path 68 and is guided toward a target, not shown. Upon reaching close proximity to the target, the sensors are activated and locate targets that have not been hit, as well as those that have been hit, in accordance with the description contained hereinabove. The discriminator then eliminates the targets which have been previously hit by, e.g. other rounds, and an appropriate target is selected. The preferred projectiles are single warhead type units and sequential timing of delivery of the units is obtained by instructing the mortar crew to fire at, e.g. ten-second intervals. In this manner, the first mortar round would strike its selected target and initiate a petroleum fire which would be sensed by the second mortar round. The target marked by the strike of the first round would be eliminated as a possible target by the target selector in the second mortar round. In this manner, a complete tank column may be destroyed by the firing of a series of mortars equal in number to the number of tanks in the column, and no duplication of target strikes would occur.

It should be noted that the time sequencing of the sub-vehicles in the method of the present invention may be accomplished either by timed releases from the "mothership" or, for example, by high altitude releases from the mothership, and timed releases of parachutes which suspend the sub-vehicles of the present invention. The time sequencing of the sub-vehicle may not necessarily, but preferably, exceeds the sub-vehicle flight time for each of the prior sub-vehicles in order to guarantee that sufficient time exists to reject previously engaged targets. When the subject sub-missiles are launched from mortar tubes, the timing sequence is achieved by sequential firing from the tubes which is controlled by the operating personnel. The mortar crew, for instance, can be instructed to launch no more than one sub-vehicle every ten seconds.

Although there have been described above specific arrangements of a sequential time discrimination system for sub-delivery systems in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

I claim:

1. A sub-vehicle control system for independently targetable sub-vehicles comprising:

an independent sub-vehicle control system for directing the sub-vehicle to a target;

sensor means capable of locating and identifying previously hit targets;

target locating means;

discrimination means for receiving data from the sensor means and from the target locating means to eliminate targets identified by the locating means which have also been identified by said sensor means; and selection means for sensing the output from the discrimination means, selecting a target other than one identified by the sensor means and causing the control system to direct the sub-vehicle to said selected target.

2. The system of claim 1 wherein the sensor means is sensitive to petroleum fires.

3. The system of claim 1 further including an independent marker for producing a marking, after impact, capable of being sensed by said sensor means.

4. The system of claim 3 wherein said marker is a flammable petroleum-based material adapted for detonation and combustion upon impact.

5. The system of claim 3 wherein the marker is contained within a warhead which explodes on impact with the selected target.

6. A carrier vehicle carrying a plurality of sub-vehicles, each having a control system in accordance with claim 1, further including dispensing means for releasing the sub-vehicles at predetermined time intervals.

7. The vehicle in accordance with claim 6 wherein the predetermined time interval is selected to exceed the flight time of a sub-vehicle from launching to impact.

8. The vehicle in accordance with claim 6 wherein the predetermined time interval is selected to provide sufficient time for sensing a previously hit target and directing a sub-vehicle to an alternative target.

9. The sub-vehicle control system of claim 1 wherein the sub-vehicles are mortar rounds capable of being sequentially launched.

10. The system of claim 9 further comprising an independent marker for producing a marking, after impact, capable of being sensed by said sensor means.

11. The system of claim 10 wherein the marker is a flammable petroleum-based material contained in a warhead on the sub-vehicle which detonates on impact and ignites the petroleum-based material.

* * * * *